United States Patent [19]

Tsuda et al.

[11] Patent Number: 4,490,438

[45] Date of Patent: Dec. 25, 1984

[54] STEEL SHEET WITH MULTILAYER ELECTROPLATING AND METHOD OF PRODUCING SAME

[75] Inventors: Tetsuaki Tsuda, Nishinomiya; Tatsuo Kurimoto, Wakayama; Atsuyoshi Shibuya, Otokuni, all of Japan

[73] Assignee: Sumitomo Metal Industries, Ltd., Osaka, Japan

[21] Appl. No.: 463,240

[22] Filed: Feb. 2, 1983

[30] Foreign Application Priority Data

| | | | |
|---|---|---|---|
| Feb. 3, 1982 | [JP] | Japan | 57-16819 |
| Nov. 17, 1982 | [JP] | Japan | 57-201427 |
| Nov. 18, 1982 | [JP] | Japan | 57-203488 |

[51] Int. Cl.[3] ..... C25D 5/10

[52] U.S. Cl. ..... 428/613; 428/659; 428/684; 428/687

[58] Field of Search ..... 428/658, 659, 684, 614, 428/613, 687

[56] References Cited

U.S. PATENT DOCUMENTS

| | | | |
|---|---|---|---|
| 2,258,327 | 10/1941 | Kramer | 428/659 |
| 3,812,566 | 5/1974 | Clauss | 428/613 |
| 4,216,272 | 8/1980 | Clauss | 428/658 |
| 4,252,866 | 2/1981 | Matsudo et al. | 428/659 |
| 4,314,893 | 2/1982 | Clauss | 428/658 |
| 4,407,900 | 10/1983 | Kirihara et al. | 428/659 |

FOREIGN PATENT DOCUMENTS

| | | | |
|---|---|---|---|
| 38494 | 4/1981 | Japan | 428/659 |
| 158864 | 12/1981 | Japan | 428/658 |
| 52494 | 3/1983 | Japan | 428/658 |
| 58294 | 4/1983 | Japan | 428/658 |
| 91187 | 5/1983 | Japan | 428/659 |

*Primary Examiner*—L. Dewayne Rutledge
*Assistant Examiner*—J. J. Zimmerman
*Attorney, Agent, or Firm*—Burns, Doane, Swecker and Mathis

[57] ABSTRACT

A steel sheet with two or more coatings and a method of producing the same are disclosed. The steel sheet has on at least one side a discontinuous surface layer of an Fe or Fe—Zn base alloy, preferably an Fe—Zn base alloy electrodeposit containing Sn in an amount of 0.01 to 50 mg/m$^2$, usually in an amount of 1.0 to 50 mg/m$^2$, preferably in an amount of 3.0 to 30 mg/m$^2$, and also 5 to 50% by weight of Zn in case Fe—Zn alloy is used, and a layer of Zn—Ni or Zn—Fe alloy electrodeposit, which lies directly under said discontinuous surface layer.

14 Claims, 10 Drawing Figures

STEEL SHEET WITH MULTILAYER ELECTROPLATING AND METHOD OF PRODUCING SAME

BACKGROUND OF THE INVENTION

The present invention relates to steel sheet, coil or plate (hereunder collectively referred to as steel sheet) with a multilayer electroplating that has high affinity for chemical conversion treatment (e.g. phosphating, hereinafter sometimes referred to as "phosphating") and can be coated with a paint coating having improved wet adhesion.

Steel sheets with platings of Zn or Zn-based alloys such as Zn—Ni and Zn—Fe systems (hereunder collectively referred to as steel sheets with Zn-base coating) are extensively used as corrosion-resistant materials in automotive parts and electrical appliances. Essentially, the mechanism of corrosion protection in these sheets consists of the electrochemical sacrificial protection of the steel substrate by the plating, or the formation of a protective film on the surface of the plating under corrosive environment.

In consideration of driving on salt-spread roads in cold districts, recently built automotive bodies are usually painted by cationic electrodeposition. However, steel sheets with Zn-base coating do not have good adhesion to paint coatings formed by cationic electrodeposition, and it is very difficult to provide by commerical application techniques a coating that has sufficient wet adhesion for use in automotive bodies.

Another problem with the steel sheet with Zn-base coating is that surface flaws such as tiny craters are easily formed in the paint coat formed by cationic electrodeposition. It is thought that these craters are formed by hydrogen gas evolved upon current impression during electrodeposition. They are very detrimental to the commercial value of the final product since they make it unsightly and reduce its corrosion resisting properties.

Under these circumstances, steel sheets with various types of duplex plating comprising two layers of plating have recently been proposed. Of these proposals, the one having the greatest potential for commercialization is a steel sheet with a continuous Fe or Fe—Zn base ($Zn \leqq 40$ wt %) outer coating and an inner Zn-base protective plating, as described in Japanese Patent Application Laid Open No. 133488/81 and No. 142885/81. This steel sheet has much better adhesion to electrodeposited paint coating than products having only a Zn-base plating, and it is quite effective in suppressing the formation of craters during paint application by electrodeposition. However, this dual plating system has its own problems.

The theory behind this dual plating is that the inner layer provides corrosion resistance whereas the outer (surface) layer provides good adhesion to the paint film. The following points must be taken into consideration when determing the quality of the Fe or Fe—Zn base alloy coating forming the surface layer. (1) The most important factor for providing a paint film having good wet adhesion is the affinity of the steel substrate for phosphating. The greater the amount of phosphophyllite ($Zn_2Fe(PO_4)_2.4H_2O$) that is formed in the phosphate film, the more wet-adhesive to the substrate the paint film is, and the opposite phenomenon occurs if more hopeit ($Zn_3(PO_4)_2.4H_2O$) is formed. The Fe or Fe—Zn alloy surface layer contributes to the production of a phosphophyllite crystal in which the constituting Fe is supplied from the surface layer, so the minimum amount of the deposition of this surface layer should be sufficient to supply Fe necessary for producing a dense phosphophyllite crystal. (2) Another factor for determining the lower limit of the deposition of the surface layer is the need to inhibit the formation of craters during cationic electrodeposition. Generally, the phosphate film does not have a 100% coverage (under the most ideal conditions, about 0.1 to 1% of the substrate area is still exposed). The Fe-rich film just beneath the phosphate coating is capable of inhibiting the formation of craters in subsequent cationic electrodeposition. As described in (1) above, the surface layer is dissolved during the phosphating operation, but to suppress the formation of craters, at least part of the surface layer must remain until the end of electrocoating. Therefore, the amount of the deposition of the surface layer must be such that not all of the layer is consumed during the phosphating. (3) On the other hand, the surface layer has a high Fe content, so if it is deposited in an excessive amount, a scratch, no matter how small it may be, will be a rust developing site. What is more, this surface layer has inherently high internal stress and does not have a very good adhesion to the inner layer. If the deposition thickness of this surface layer is increased, press working entailing increased strain causes heavy "powdering". To prevent this, the deposition of the surface layer must be held to a minimum. (4) In addition, the essential purpose of the surface layer is not to provide corrosion protection, so economy dictates that it be as thin as possible. In electroplating, the thicker the plating, the higher the variable cost, and the greater the size of the plating equipment, the higher the initial cost.

In view of the discussion above, the Fe— or Fe—Zn alloy surface plating in the duplex coating system must be as thin as possible, provided that it is thicker than the critical value necessary for providing good affinity for phosphating and preventing the formation of craters during cationic electroposition, the preferred thickness being not more than about $10g/m^2$.

As stated in Japanese Patent Application Laid Open No. 133488/81 and No. 142885/81, the surface layer of the duplex coating must be "continuous" to cover the whole area of the inner Zn-base corrosion-resistant layer (see accompanying FIG. 1(*a*) wherein the inner and surface layers are indicated by numerals 1 and 2, respectively). If the surface layer 2 is discontinuous and does not cover the inner layer 1 entirely as shown in FIG. 1(*b*) and if the electrochemical potential of the surface layer is cathodic to the inner layer, the inner layer is preferentially dissolved during phosphating, and not enough Fe is supplied from the surface layer to form a dense phosphophyllite crystal. The inner Zn-base (Zn, Zn—Fe or Zn—Ni) plating that must provide corrosion protection is usually anodic to the Fe— or Fe—Zn alloy surface plating (of high Fe content).

Because of the mechanism of deposition, an electroplated coating may often be discontinuous. In the electroplating of a metal, a multitude of active sites dispersed on the substrate serve as nuclei for starting the deposition of the metal, and the deposition of metal spreads not only in the direction of thickness but also in every direction in the plane until a continuous film that covers the whole area of the substrate is formed. The sequence of this formation is illustrated in FIGS. 2(*a*), 2(*b*) and 2(*c*), wherein symbol A represents the plating film. Therefore, in some cases, the plating operation comes to an end in stage (a) before the deposited film A has formed a continuous layer, and the resulting surface layer is discontinuous like surface layer 2 in FIG. 1(*b*) wherein micro-pores 3 are randomly distributed throughout the coating. For the mechanism of the formation of an electroplated film and its discontinuity as well as associated phenomenon, see the following references.

(i) J. A. Harrison & H. R. Thrisk, "Advances in Electrochemistry and Electrochemical Engineering", Vol. 8, page 97, Interscience Pub., John Wiley & Sons Inc. (outlining the mechanism of the formation of a plating by electrodeposition);

(ii) "Metallic Coatings for Corrosion Control", NewnesButterworths, 1977, particularly the articles entitled "Effects of discontinuities in coating" and "Anodic coatings", pp. 39–41 and FIG. 1.17;

(iii) "Properties of Electrodeposits—Their Measurement and Significance", The Electrochemical Society, Inc., 1975, particularly the paper entitled "Porosity and Porosity Tests", p. 122 (the second and third references describe the discontinuity of electroplated deposits and the galvanic corrosion resulting from such discontinuity).

In short, the Fe— or Fe—Zn surface layer of the duplex plating should be not only as thin as possible (usually not thicker than $10g/m^2$) but also continuous, rather than discontinuous as shown in FIG. 1(*b*). However, as will be readily understood from the mechanism of its formation, the discontinuous layer is more often formed when the plating is thin than when it is thick. Therefore, the two requirements that the plating be continuous and not thicker than $10g/m^2$ are generally very difficult to meet, and the conventional technique of using a simple bath, made up of a sulfate salt or chloride comprising $Fe^{2+}$ or $Fe^{3+}$ and optionally $Zn^{2+}$ supported by an inorganic salt (e.g. $Na_2SO_4$, NaCl or $Al_2(SO_4)_3$) is practically ineffective.

For the formation of micro-pores in thin layers of electroplating, see the following references.

(iv) "Effects of discontinuities in coating", p. 40 of Reference (ii), disclosing the inverse relation between the thickness of the electrodeposit and the number of micropores present;

(v) "Trend and Future of Surface Finishing Techniques in Steel Industry" in "The 52 and 53rd Nishiyama's Commemorative Lecture: Advancement of the technology for manufacturing surface-finished products and associated fileds", The Iron and Steel Institute of Japan, 1978 (showing the formation of a Sn-plating of a thickness of less than 5 $g/m^2$ which is discontinuous and entails micro-pores);

(vi) Japanese Patent Publication No. 42774/73 (showing that an electroplated Zn coating has a number of pinholes or micro-pores when its thickness is less than 10 $g/m^2$); and (vii) "The sine-wave pulse plater" in "International Pulse Plating Symposium", American Electroplaters Society, Inc., 1979) showing the high porosity of an electroplated gold film thinner than 3 $\mu m$).

A conventional method of reducing the porosity (micropores) of a thin plating film consists of adding to the plating bath a complexing agent, such as a chelating agent, a cyanide, an organic acid (e.g. citric acid or succinic acid), or an organic additive (e.g. glue, dextrin, tetrabutyl ammonium, bromide, or benzalacetone). However, this method has a problem that prevents its extensive use: the amount of the complexing agent in the bath varies with a continued fluctuation in operating conditions, whereas measurement of its concentration is quite difficult making quality control of the bath infeasible.

Even if the desired continuous thin surface plating is successfully produced by this method, an unavoidable problem arises when the steel sheet with this coating is put to service. The sheet is usually subjected to various forming operations such as press working by the user such as a car manufacturer, and then it is chemical-converted, e.g. phosphated and painted, but the deformation applied to the work in the car manufacturing process is usually relatively severe, hence discontinuities (micro-cracks) often develop in the surface of the Fe— or Fe—Zn plating which inherently has high internal stress. In other words, it is highly likely that discontinuity (porosity) will be introduced into the plating film during the forming step even if it was suppressed during the platingstage. As already mentioned, a duplex coating having such a discontinuous surface plating layer cannot have improved affinity for phosphating. Specific data of the experimental work done to investigate the introduction of discontinuities into an electrodeposit by forming operation and the resultant effects are reported in the following reference:

(viii) "Steel Sheet with Zn—Fe/Zn—Ni Duplex Alloy Electroplating —Its Workability and Corrosion Resistance after Working" in "Metal Surface Finishing", Vol. 33, No. 10, pp. 505–508, 1982 (showing the presence of micro-cracks in the surface Fe—Zn layer of the Fe—Zn/Zn—Ni duplex electrodeposit on the steel sheet that has been subjected to forming operation; since the inner Zn—Ni layer is cathodic to the surface layer, the phosphophyllite content of the phosphate film is decreased by a degree that depends on the severity of the mechanical deformation).

As described in the foregoing, the steel sheet with Fe— or Fe—Zn base/Zn—base duplex coating has many problems to be solved before it can be extensively used on a commercial scale. None of the existing plated steels are completely satisfactory as commerical products.

OBJECTS OF THE INVENTION

A general object of the present invention is to provide a steel sheet with multilayer coating that eliminates the problems mentioned hereinbefore without sacrificing the corrosion resistance and other features of the steel sheet with Fe— or Fe—Zn base/Zn—base duplex coating.

A specific object of the present invention is to provide a steel with multilayer coating that meets the following requirements:

(1) it is equal to cold-rolled steel sheet in respect to its affinity for chemical conversion treatment, e.g. phosphating, and paint coatings having consistently good wet adhesion can be formed by cationic electrodeposition;

(2) it is also equal to the steel sheet with duplex Fe—Zn base/Zn base coating in respect to its resistance to corrosion and inhibition of craters during cationic electroplating;

(3) the thin surface layer of the plating can be produced using a conventional, simple plating bath without any special means;

(4) its affinity for chemical conversion, i.e. phosphating, which is equal to that of cold-rolled steel sheets, is not impaired if micro-defects such as micro-cracks are introduced into the thin surface layer after the sheet is subjected to working under severe conditions.

BRIEF DESCRIPTION OF THE INVENTION

As described above, the thin surface layer of the Fe— or Fe—Zn base/Zn base duplex plating must be continuous, but the objects of the invention (3) and (4) mentioned above cannot be met with a continuous surface layer. If a thin discontinuous film can be used as the surface layer, no special provision is necessary for producing a continuous layer and there will be no need to worry about the introduction of micro-cracks and other micro-defects as a result of working operations.

Figure 1A:
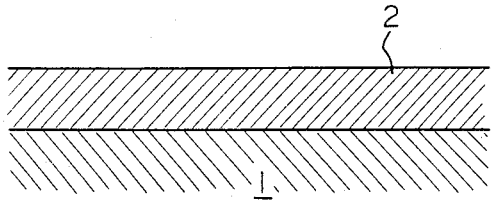
FIGS. 1(*a*) and 1(*b*) show schematically the surface of a duplex metal coating on a steel sheet, wherein FIG. 1(*a*) shows a continuous surface layer and FIG. 1(*b*) shows a discontinuous surface layer.
Figure 1:
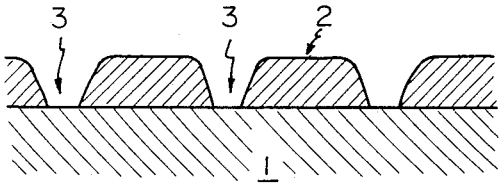
Figure 2A:
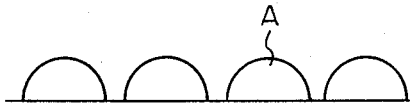
FIGS. 2(*a*), 2(*b*) and 2(*c*) show the sequence of the growth of an electrodeposit.
Figure 2B:
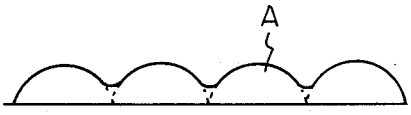
Figure 2C:
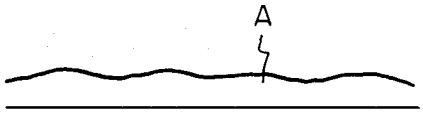

Therefore, based on the idea of using a discontinuous film rather than a continuous film as the surface layer of duplex plating, the present inventors have made various studies to discover effective means to prevent the discontinuous layer from becoming less susceptible to phosphating. As a result, the inventors have made the following observations:

(A) If the surface layer of the plating is discontinuous as shown in FIG. 1(*b*), the inner layer is preferentially dissolved in the phosphating operation, and the Fe-rich surface layer makes no contribution to the formation of a phosphophyllite crystal. This is entirely due to the potential of the inner layer which is anodic to that of the surface layer, and this electrochemical relation can be reversed (i.e. the potential of the surface layer made anodic to the inner layer) by incorporating a suitable amount of Sn in the surface layer. If the potential of the surface layer is anodic to the inner layer, said surface layer may be safely discontinuous because the dissolution reaction that accompanies the phosphating operation always occurs in the surface layer, not the inner layer, and the Fe content supplied from that surface layer is effectively used to provide phosphyllite-rich dense phosphate crystals. The mechanism by which the addition of Sn reduces the potential of the surface layer has not been thoroughly studied and at this point defies clearer explanation, (B) Tin in the surface layer forms a micro-cell with Fe in the same surface layer, and in the phosphating operation, it acts as a cathode and accelerates the dissolution of Fe. Tin in the surface layer also helps produce more phosphate crystal nuclei. As a result, that tin is effective in increasing the phosphophyllite content of the phosphate crystal.

Therefore, the present invention is characterized by a steel sheet with two or more coatings having on at least one side a discontinuous surface layer of an Fe or Fe—Zn base alloy, preferably an Fe—Zn base alloy electrodeposit containing Sn in an amount of 0.01 to 50 mg/m$^2$, usually in an amount of 1.0 to 50 mg/m$^2$, preferably in an amount of 3.0 to 30 mg/m$^2$, and also 5 to 50% by weight of Zn in case Fe—Zn alloy is used, and a layer of Zn, Zn—Ni, or Zn—Fe alloy, preferably Zn—Ni or Zn—Fe alloy electrodeposit, which lies directly under said discontinuous surface layer.

The present invention is also characterized in that the electrodeposition plating of the surface layer is carried out under control of an effective concentration of Sn in the plating bath in accordance with the following equation:

$$\text{Effective Concentration of Sn in the plating bath} = [Sn^{2+}\text{ ion concentration}] + \alpha[Sn^{4+}\text{ ion concentration}]$$

wherein, the coefficient $\alpha$ is 0.9 to 0.5.

DETAILED DESCRIPTION OF PREFERRED EMBODIMENTS OF THE INVENTION

(Surface layer of the plating)

Theoretically, the surface layer of the plating formed in the present invention may be based on Fe or Fe—Zn, but in view of the efficiency of the chemical conversion operation, e.g. phosphating operation (hereunder referred to as "phosphating"), the Fe-base plating, i.e. Fe plating is less economical. The phosphating reaction occurs more slowly in a steel sheet with Fe coating than in an as-cold rolled steel sheet, and the time required to phosphate the former is about twice that necessary for phosphating the latter. The as-cold rolled steel sheet has $Fe_3C$, Mn oxide, or Cr oxide suitably distributed over the surface, and this may accelerate the phosphating reaction by forming local cells, but the steel sheet with Fe electrodeposit has a purer surface that inhibits the dissolution in the phosphating solution.

Figure 3:
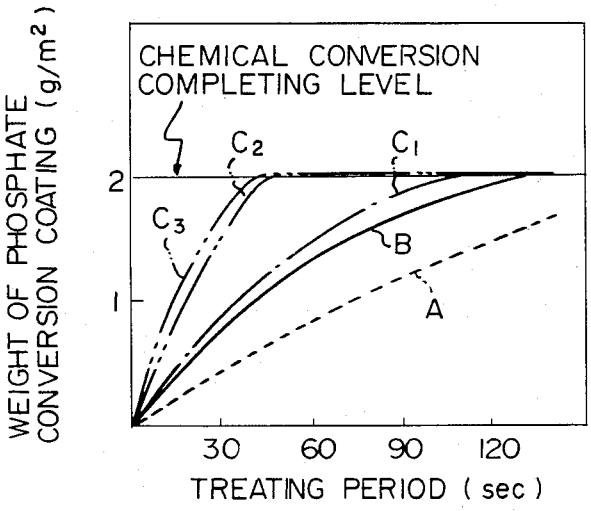
FIG. 3 is a graph showing the phosphating speeds of a cold-rolled steel sheet and four different steel sheets with duplex metal coating.

The present inventors have confirmed by experiment that the Fe—Zn base alloy electrodeposit has a much faster phosphating rate than the as-cold rolled sheet. FIG. 3 shows the phosphating speeds (the time required for completing the phosphating operation) of five samples: a discontinuous layer of Fe plating A (Sn content: 5 mg/m$^2$), a cold-rolled steel sheet B, a discontinuous layer of Fe—Zn alloy plating $C_1$ (Zn content: 5 wt %, Sn content: 5 mg/m$^2$), a discontinuous layer of Fe—Zn alloy plating $C_2$ (Zn content: 15 wt %, Sn content: 10 mg/m$^2$) and a discontinuous layer of Fe—Zn alloy plating $C_3$ (Zn content: 50 wt %, Sn content: 15 mg/m$^2$). Each of samples A and C was the surface layer of dual coating on a steel sheet (inner layer: 87 wt % Zn—13 wt % Ni alloy electrodeposit), which was phosphated by dipping in a solution of SD 2000 (Nippon Paint Co., Ltd.) at 50° C. FIG. 3 shows that while the Fe plating is phosphated more slowly than the cold-rolled steel sheet, the Fe—Zn alloy plating with more than 5 wt % of Zn is phosphated faster than the cold-rolled sheet. The main cause of this difference in phosphating speed between the Fe plating and Fe—Zn alloy plating is zinc. If Zn is present, many local cells are formed between Fe and Zn in the coating to accelerate the phosphating reaction. It is to be noted that the five samples subjected to the above experiment produced phosphophyllite-rich, dense phosphate crystals.

According to one embodiment of the present invention, the Zn content of the surface layer of the Fe—Zn plating is limited to the range of 5 to 50 wt %. If the Zn content is less than 5 wt %, the phosphating speed is slower than in the case of the cold-rolled sheet and is not desirable for efficient operation. If the Zn content exceeds 50 wt %, the affinity of the surface plating for phosphating is not as high as that of the cold-rolled sheet.

Figure 4:
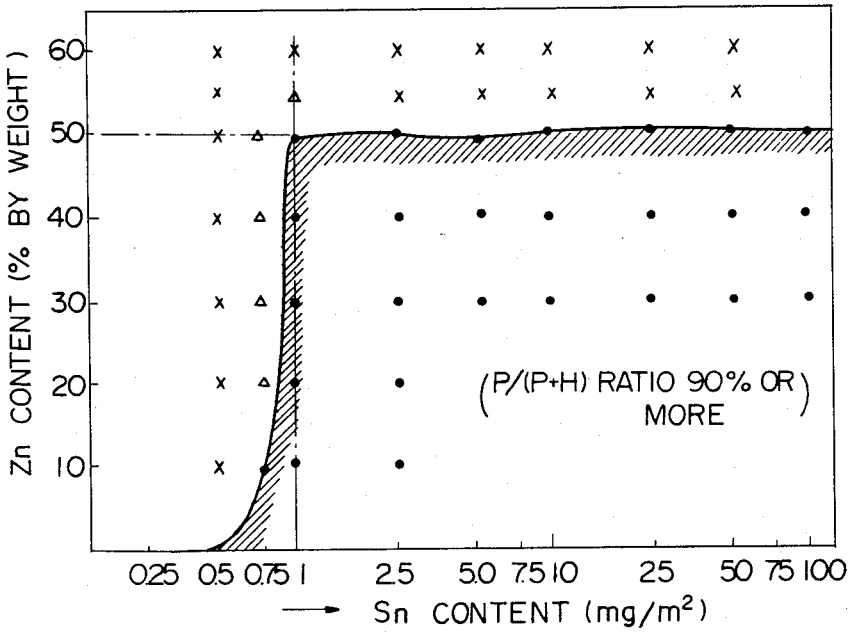
FIG. 4 is a diagram depicting the effects of the Zn and Sn content of the surface layer of an Fe—Zn/-Zn—Ni duplex coating on the formation of a phosphate crystal.

FIG. 4 shows the effects of Zn content and Sn content (to be described later) of the surface plating on the phosphophyllite content of the phosphate crystal. The specific values of the P/(P+H) ratio are listed in the examples to be described later. The samples used were those obtained frcm a steel sheet with dual coating (discontinuous Fe—Zn surface layer and 87 wt % Zn—13 wt % Ni inner layer) and were phosphated under the same conditions as for the experiment of FIG. 3. In FIG. 4, the solid dots indicate P/(P+H) values of 90% or more, the open triangles indicate values of 60–90%, and the X's indicate values of less than 60%. The shaded area in FIG. 4 presents the cases in which steel sheets can show affinity for phosphating as high as the cold rolled steel sheets. One can easily see from FIG. 4 that if the Zn content exceeds 50%, affinity for phosphating equal to that of the cold-rolled steel sheet is not obtained, no matter what the Sn content is. If the Zn content exceeds 35 wt %, a scratch mechanically formed in the paint coat during service,such as a scratch formed on the automotive body while the car is running on the road and hit by pebbles or gravel becomes the starting point of corrosion that progresses downward and parallel to the paint coat, forming a blister. Therefore, a Zn content of not more than 35 wt % is most preferred for practical purposes. If the Zn content is more than 20 wt %, a pattern that corresponds to the flow of the plating solution during the electroplating appears on the resulting deposit. This pattern has no effect on the performance of the surface layer but is unsightly.

According to another embodiment of the present invention, Sn is incorporated in the Fe—Zn alloy plating as described hereinbefore. As mentioned earlier, Sn in the Fe—Zn alloy coating shifts the electrochemical potential of the surface layer toward the anodic side with respect to the inner layer. Stated more specifically, an Fe—Zn alloy coating with 5 to 50 wt % Zn and a high Fe content (more than 50 wt % and less than 95 wt %) is usually cathodic to a corrosion-resistant inner layer to be described later (a Zn—Ni alloy electrodeposit with 5 to 20 wt % Ni or an Fe—Zn alloy electrodeposit with 10 to 40 wt % Fe). However, by adding Sn to the Fe-rich Fe—Zn alloy coating, its potential can be rendered anodic to the inner layer. Tin by itself is electrochemically cathodic to Fe, but when it is incorporated in the Fe—Zn alloy electrodeposit in a trace amount, the potential of that electrodeposit is shifted to the anodic side with respect to the inner layer. Details of the theory behind this phenomenon have yet become clear.

By incorporating Sn having these effects, the surface layer of Fe—Zn alloy can be rendered discontinuous and at the same time, the surface layer will be preferentially dissolved in the phosphating operation to provide phosphophyllite-rich, dense phosphate crystals. As already mentioned, Sn has other advantages: it forms a micro-cell with Fe in the surface layer and accelerates the dissolution of Fe in the phosphating operation. At the same time, it increases the number of phosphate crystal nuclei formed, thus effectively increasing the phosphophyllite content of the phosphate crystal.

Figure 5:
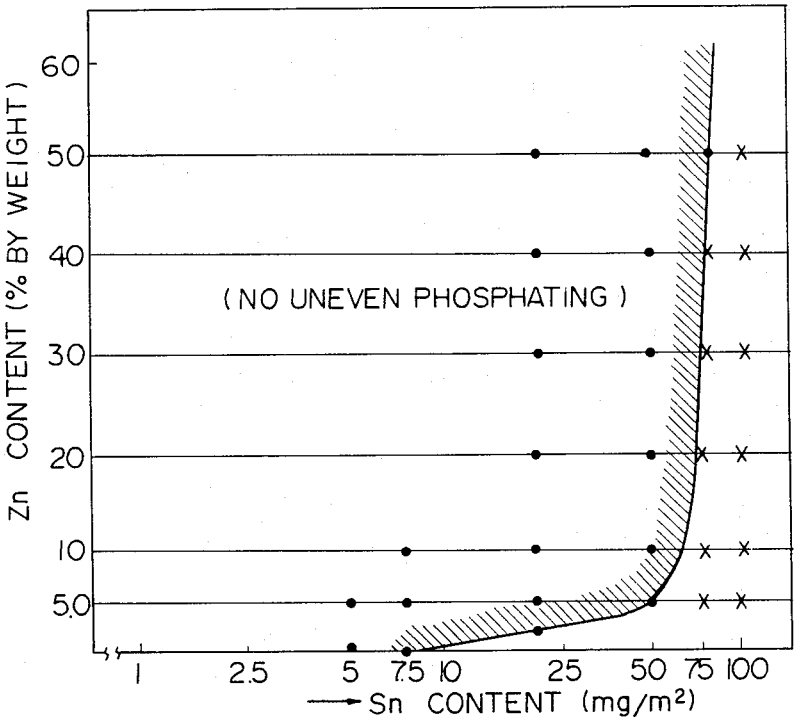
FIG. 5 is a diagram depicting the effects of the Zn and Sn content of the surface of the same duplex coating on the uniformity of phosphating.

The Sn content should be in the range of from 0.01 to 50 mg/m$^2$. If the Sn content is less than 0.01 mg/m$^2$, the desired phosphophyllite-rich phosphate crystal is not obtained. This is probably because Sn present in an amount of less than 0.01 mg/m$^2$ is not sufficient to make the surface layer anodic to the inner Zn—Ni or Zn—Fe layer, and under this condition, the discontinuous surface layer will not be preferentially dissolved during the phosphating operation. If the Sn content is more than 50 mg/m$^2$, uneven deposition of phosphate crystals may occur with a Zn content of 5 wt % or more (the range defined by the present invention). This is apparent from FIG. 5, which shows the results of an experimental phosphating conducted under the same conditions as employed in obtaining the data for FIG. 4 (in FIG. 5, the solid dots indicate the absence of uneven phosphating, and the X's indicate its presence). For these reasons, the Sn content of the surface layer is limited to the range of a 0.01 to 50 mg/m$^2$ Usually, the Sn content is 1.0 to 50 mg/m$^2$ However, in actual continuous plating operations, some variation in the plating conditions is unavoidable and producing coatings of consistent composition is almost impossible. Therefore, for practical purposes, an Sn content of 3 mg/m$^2$ or more is recommended. If the Sn content exceeds 30 mg/m$^2$, relatively large phosphase crystals comprising platy crystals intermingled with semi-circular disk type crystals may be formed when the Zn content is on the lower side (less than about 15 wt %). Therefore, an Sn content ranging from 3 mg/m$^2$ to 30 mg/m$^2$ is most preferred.

The Sn content is defined in terms of mg/m$^2$ rather than wt % for the following reasons.

(I) Because of the nature of the surface layer, unless there is excessive segregation, a variation in the concentration of Sn in the direction of the thickness as well as longitudinal/transversal directions of the coating, (for example, a variaton amounting to 0.001 to 10 wt %) will cause no problem at all. This means that it is meaningless to define the amount of Sn in terms of "wt %". The only requirement is the formation of a local cell between Fe (anode) and Sn (cathode), and this helps the surface layer to achieve its intended functions. For the purpose of determing the formation of the local cell, therefore, it is practical to define the Sn content in terms of "mg/m$^2$".

(II) Multilayer coating (for example, duplex coating) of the type contemplated by the present invention defies exact measurement of the composition of the respective layers and their amounts of deposition, and it is virtually impossible to measure the Sn content of the surface layer in terms of percentage. However, Sn in mg/m$^2$ can be determined by dissolving the whole duplex coating in an acid, and then measuring the Sn concentration in solution though atomic-absorption spectroscopy or ICPQ method. Therefore, by using mg/m$^2$, the Sn content can be properly controlled during the plating operation. For these two reasons, the Sn content is defined in terms of $mg/m^2$ in the present invention.

Figure 6:
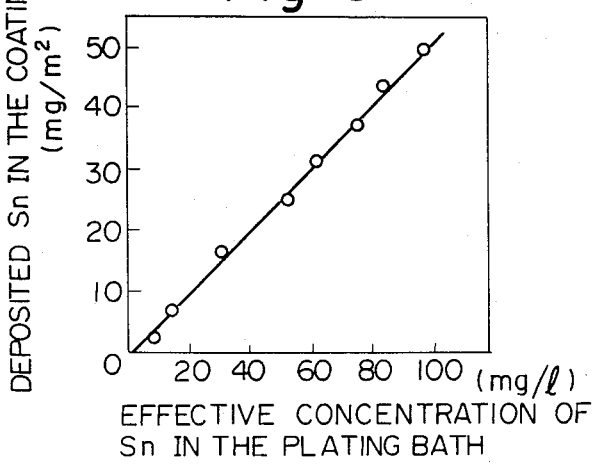
FIG. 6 is a diagram showing the relation between the concentration of available Sn in the bath for Sn-containing Fe—Zn alloy electroplating and the Sn content of the resulting deposit.

Tin can be incorporated in the Fe—Zn alloy electrodeposit by adding Sn ions in the plating bath. The concentration of available Sn ions (CSn) is defined by the following equation:

$$CSn = [\text{conc. of } Sn^{2+} \text{ ion}] + \alpha[\text{conc. of } Sn^{4+} \text{ ion}]$$

wherein, $\alpha$ is a coefficient (0.9–0.5) selected according to the pH of the plating bath (pH=0.5 to 5.0). The relation between CSn and the amount of Sn in the electrodeposit ($mg/m^2$) is nearly linear as illustrated in FIG. 6 Therefore, by controlling the CSn of the plating bath, the deposition of Sn can be controlled to provide an Fe—Zn alloy electrodeposit containing the desired amount of Sn.

It is supposed that the reason why some amount (10–50%) of $Sn^{4+}$ ions is not available to electrodeposition is that during the Fe—Zn (or Fe) electroplating, the pH in an area adjacent to the surface of electrode is increased in comparison with the bulk pH, i.e. the pH of the plating bath in an area away from the surface of electrode, so the reduction of $Sn^{4+}$ to $Sn^{2+}$ and the formation of colloidal $Sn(OH)_4$ occur in the area within a diffusion layer adjacent to the electrode surface.

According to experiments, the value of said coefficient was about 0.7 for the case in which the inner electrodeposit coating consisted of Fe—Zn alloy (30% Fe-70% Zn), the surface electrodeposit coating consisted of 100% Fe, and the plating conditions for the surface layer were:

| | |
|---|---|
| Plating bath: | $Fe^{2+}$ = 1 kmol/$m^3$ |
| | $Na_2SO_4$ = 0.5 kmol/$m^3$ |
| Bath temp.: | 60° C. |
| Current applied: | 50 A/$dm^2$ |

The effective Sn ion concentration ($C_{Sn}$) is preferably in the range of from 5 to 100 mg/l. Within this range, as is apparent from the graph shown in FIG. 7, the content of Sn in the coating can be controlled precisely.

There is no particular limitation on the thickness of the surface layer of electrodeposit, and it varies in a complex manner with the potential difference between the surface layer and the underlying layer, and the size and distribution of micro-pores in the surface film. The proper thickness is determined in view of these and other factors such as affinity for phosphating treatment, inhibition of craters, cosmetic corrosion (red rust) and "powdering" from press working, as well as economic considerations. Generally, a thickness of about 1 to 10 $g/m^2$ may be used, and the range of from 1.5 to 6 $g/m^2$ is preferred.

Figure 7:
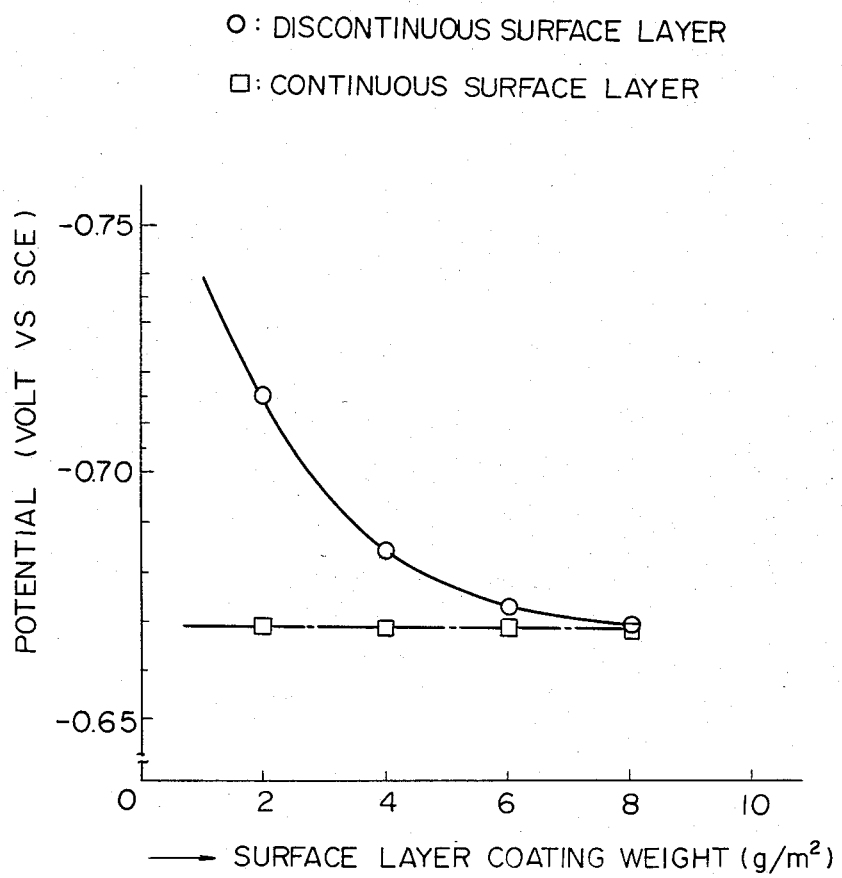
FIG. 7 compares the immersion potential of a steel sheet with Fe—Zn/Zn—Ni duplex electroplating having a continuous surface layer with the immersion potential of a steel sheet with the same duplex plating but having a discontinuous surface layer.

The surface layer according to the present invention should be discontinuous and its discontinuity can be checked by measuring the potential of the duplex coating with a selected electrolyte, making use of the phenomenon that the potential of a steel sheet with the duplex coating when immersed in an electrolyte varies according to whether the surface layer is continuous or not. If the surface layer is continuous, the surface layer is the only factor that governs the immerison potential, but if it is discontinuous, not only the surface layer but also the inner layer that lies right beneath it are the determining factors. A profile of this phenomenon is shown in FIG. 7 which is the result of measurement of the potential (vs SCE) of steel sheets with dual coating consisting of an inner layer (87 wt % Zn-13 wt % Ni alloy electrodeposit and an outer layer (85 wt % Fe—Zn alloy electrodeposit when the electrodeposited outer layer contained Sn in an amount of 7.5 mg./$m^2$, the potential was at a constant level, e.g., approximately −0.9 volt vs. SCE. immersed in a phosphate solution (pH: 3, 15° C.). In one steel sheet, the surface layer was continuous, and in the other, it was discontinuous. The weight of the plating deposited is plotted on the x-axis. For a discontinuous coating, the coating weight may be considered as the coverage of the surface layer. As shown, the immersion potential for the continuous surface layer assumes a constant value (i.e. the potential of the surface layer), which is cathodic to the immersion potential for the discontinuous surface layer. This is because the potential of the inner layer which is anodic to the surface layer has definite effects on the discontinuous outer layer. FIG. 7 shows that the greater the coverage of the discontinuous surface layer, the smaller the difference from the potential for the continuous surface layer. This is because the effect of the inner layer varies according to the extent of the coverage of the surface layer, or in other words, with the degree of exposure of the inner layer.

(Inner layer right beneath the surface layer)

In a still another embodiment of the present invention, this inner layer is formed by electrodepositing from a Zn—Ni alloy or Zn—Fe alloy. As described in the foregoing, the principle behind the present invention is to form a discontinuous surface layer of Fe—Zn alloy electrodeposit which has incorporated therein a trace amount of Sn to redner the potential of the surface layer anodic to the inner layer which lies right beneath it, the inner layer being formed of a Zn base alloy plating that is cathodic to the surface plating layer of Fe—Zn alloy and provides corrosion protection. Since the potential of the surface layer must be anodic to the underlying inner layer, the latter must be made of a corrosion-resistant plating or Zn base alloy eelectrodeposit that is cathodic to the surface layer of Fe—Zn alloy. If the inner layer is simply made of Zn plating, its potential cannot be cathodic to the Fe—Zn alloy surface layer, even if the latter contains Sn. During phosphating, the zinc in the inner layer is preferentially reacted with the phosphating solution, producing only coarse and hopeite-rich phosphate crystals. To inhibit the reaction between the phosphating solution and the inner layer and keep the latter substantially intact throughout the phosphating, the inner layer is preferably formed of Zn—Ni or Zn—Fe alloy electrodeposit which is cathodic to the surface layer made of Sn-containing Fe—Zn alloy electrodeposit.

Corrosion protection by the Zn-alloy electrodeposit can be provided by 5 to 20 wt % Ni if the alloy is Zn—Ni based and by 10 to 40 wt % Fe if the alloy is Zn—Fe based. The effectiveness of the inner layer made of Zn—Ni or Zn—Fe alloy electrodeposit is not affected by incorporating in said layer a small amount of at least one element selected from among Cr, Fe, Co, Ni, Cu, Al, Mg, and Mn, and this is also included in the scope of the present invention.

The thickness of the inner layer required to provide corrosion protection is determined by the specific use and other factors, but for use in automotive bodies, a thickness between about 20 and 40 g/m$^2$ is generally used.

The steel sheet with multiplex coating has on one surface an outer layer made of the Sn-containing Fe—Zn alloy electrodeposit, and situated right beneath it, an inner layer made of the Zn—Ni or Zn—Fe alloy electrodeposit. The multiplex coating may consist of three or more platings, and in such a triplex coating system, the third layer is placed beneath the inner layer of Zn—Ni or Zn—Fe alloy electrodeposit, and it may be made of any suitable metal plating such as a Cu plating to provide increased adhesion to the steel substrate, a Ni plating to prevent the formation of micro-cracks in the overlying layers, or a Cr plating to enhance the corrosion resisting properties of the Zn—Ni or Zn—Fe alloy electrodeposit.

The multiplex coating of the present invention need not be applied to both surfaces of the steel substrate. It may be applied to only one surface of the substrate, with the other side left uncoated or coated with a plating of different composition. These modifications are also included in the scope of the present invention.

The present invention is now described in greater detail by reference to the following examples which are given here for illustrative purposes only and are by no means intended to limit the scope of the invention.

EXAMPLES

Fourteen steel sheet samples having the surface and inner layers shown in Table 1 were produced by electroplating or hot dip plating: 9 of them had a duplex coating, 3 had a triplex coating, and the remaining two had a simplex coating. The Sn-containing Fe—Zn alloy electrodeposits forming the surface layers of Samples No. 3 to 14 were produced by a method wherein Sn was incorporated in an Fe—Zn alloy electroplating bath as $SnSO_4$ and the co-deposition of Sn was controlled by controlling the concentration of available Sn (CSn), which has previously been described by reference to FIG. 6. The plating baths used to produce Samples Nos. 4 to 14 were simple ones containing 250 g/l of $FeSO_4 \cdot 7H_2O$, 75 g/l of $Na_2SO_4$, and various concentrations of $ZnSO_4 \cdot 7H_2O$, and the bath for Sample No. 3 contained 248 g/l of $FeSO_4 \cdot 7H_2O$, 118 g/l of $(NH_4)_2SO_4$, 60 g/l of $ZnSO_4 \cdot 7H_2O$, and 0.5 g/l of citric acid (complexing agent) to form a continuous plating layer.

The samples were dipped in a phosphate solution (SD 2000 of Nippon Paint Co., Ltd.) at 50° C., and given sequentially a cationic electrodeposited paint coat 20μ thick, an intercoat 30μ thick, and a topcoat 40μ thick. The time required to complete the chemical conversion treatment, i.e. phosphating treatment for each sample was measured. The microstructure of the phosphate crystal formed was studied by calculating its P/(P+H) ratio, which was determined by evaluating the strength of a (100) plane of phosphophyllite (P) and that of a (020) plane of hopeite (H) using X-ray diffractionmetry. The samples with the topcoat were subjected to an adhesion test consisting of immersing the sample in ion-exchanged water at 50° C. for 10 days, cutting parallel grooves 2 mm apart through the cationic electrodeposit, intercoat, and topcoat into the outer layer of the plating, applying an adhesive tape over the cross-hatched area, quickly pulling said tape off, and counting the number of intact squares in the grid. The results are shown in Table 1.

TABLE 1

| | plating composition | | | | |
|---|---|---|---|---|---|
| | surface layer | | | inner layer (right beneath the surface layer) | |
| No. | deposit composition | conti-nuity* | coating weight (g/m$^2$) | deposit composition | coating weight (g/m$^2$) |
| conventional | | | | | |
| 1 | — | — | — | 13% Ni, bal. Zn | 25 |
| 2 | — | — | — | 20% Fe, bal. Zn | 25 |
| 3 | 25% Zn, 75% Fe | A | 5 | 10% Fe, 0.1% Al, bal. Zn | 45*** |
| 4 | 25% Zn, 75% Fe | B | 5 | 10% Fe, 0.1% Al, bal. Zn | 45*** |
| comparative | | | | | |
| 5 | 30% Zn, Sn 100 mg/m$^2$, bal. Fe | " | 2 | 13% Ni, 0.1% Cr, bal. Zn | 25 |
| the present invention | | | | | |
| 6 | 30% Zn, Sn 5 mg/m$^2$, bal. Fe | " | 3 | 13% Ni, bal. Zn | 25 |
| 7 | 30% Zn, Sn 10 mg/m$^2$, bal. Fe | " | 3 | " | 25 |
| 8 | 30% Zn, Sn 25 mg/m$^2$, bal. Fe | " | 2 | 13% Ni, Co 1%, bal. Zn | 25 |
| 9 | 30% Zn, Sn 50 mg/m$^2$, bal. Fe | " | 1.5 | 13% Ni, bal. Zn | 25 |
| 10 | 20% Zn, Sn 7.5 mg/m$^2$, bal. Fe | " | 5 | 20% Fe, 0.05% Mn, bal. Zn | 25 |
| 11 | 20% Zn, Sn 15 mg/m$^2$, bal. Fe | " | 4 | 20% Fe, 5% Ni, bal. Zn | 25 |
| 12 | 20% Zn, Sn 30 mg/m$^2$, bal. Fe | " | 3 | 20% Fe, bal. Zn | 15 |
| comparative | | | | | |
| 13 | 28% Zn, Sn 60 mg/m$^2$, bal. Fe | " | 3 | 0.9% Fe, 0.2% Pb, 0.25% Al, bal. Zn | 90*** |
| 14 | 25% Zn, Sn 5 mg/m$^2$, bal. Fe | " | 3 | Zn | 60 |

TABLE 1-continued

| 15 | Cold-rolled (CC killed, recrystallization annealed, and temper rolled) steel sheet | | | | | | | |
|---|---|---|---|---|---|---|---|---|
| | plating composition innermost layer | | conversion treatment | | | | residual squares | |
| | deposit | coating weight | period (sec)** | | P/(P + H) ratio (%)** | | in adhesion test (%)** | |
| No. | composition | (g/m²) | #1 | #2 | #1 | #2 | #1 | #2 |
| conventional | | | | | | | | |
| 1 | — | — | 52 | 59 | 0 | 0 | 30 | 45 |
| 2 | — | — | 55 | 64 | 0 | 0 | 40 | 35 |
| 3 | — | — | 65 | 61 | 94 | 97 | 93 | 98 |
| 4 | — | — | 59 | 63 | 54 | 62 | 61 | 54 |
| comparative | | | | | | | | |
| 5 | metallic Ni | 2 | | excessive uneven deposition of phosphate crystals | | | — | — |
| the present invention | | | | | | | | |
| 6 | — | — | 62 | 51 | 95 | 90 | 95 | 96 |
| 7 | Cr and hydrated Cr oxide | 2 | 55 | 53 | 98 | 94 | 94 | 99 |
| 8 | — | — | 55 | 61 | 95 | 96 | 98 | 96 |
| 9 | — | — | 50 | 65 | 100 | 95 | 97 | 99 |
| 10 | — | — | 56 | 62 | 98 | 95 | 95 | 98 |
| 11 | — | — | 48 | 53 | 99 | 91 | 99 | 92 |
| 12 | metallic Zn | 10 | 57 | 61 | 96 | 97 | 100 | 94 |
| comparative | | | | | | | | |
| 13 | — | — | | slightly uneven deposition of phosphate crystals | | | 33 | 57 |
| 14 | — | — | 55 | 51 | 54 | 42 | 25 | 19 |
| 15 | | | 120 | 110 | 98 | 92 | 94 | 100 |

*A: continuous, B: discontinuous
**Two specimens (#1, #2) of each sample were tested.
***Galvannealed steel sheet,
****Galvanized steel sheet As shown in Table 1, Sample No. 1 with a simplex coating of Zn—Ni alloy and Sample No. 2 with a simplex coating of Zn—Fe alloy had a P/(P+H) ratio of zero and withstood the adhesion test very poorly. Obviously, the alloy electrodeposits on these samples had a very poor affinity for chemical conversion, i.e. phosphating and could not form a paint coat having good wet adhesion. Sample No. 3, which was an example of the conventional product had a duplex coating with a continuous Fe—Zn alloy surface layer, exhibited a high phosphating rate and high P/(P+H) ratio, and withstood the adhesion test satisfactorily. Nevertheless, this sample required special means (addition of a complexing agent in the plating bath) in order to be produced, and was not ideal from the standpoints of cost and the ease of bath control. Sample No. 4 was the same as Sample No. 3 except that the surface layer of the plating was discontinuous, but its affinity for phosphating was very low and no paint coat having good wet adhesion could be formed.

Samples No. 6 to 12 were prepared according to the present invention; they had surface layers made of Fe—Zn alloy electrodeposits containing 1.0 to 50 mg/m² of Sn and 5 to 50 wt % of Zn, and inner layers situated right beneath that were made of Fe—Zn or Ni—Zn alloy electrodeposits. Samples No. 7 and 12 also had a third layer made of a metal electrodeposit that was beneath the Fe—Zn or Ni—Zn layer. Although these seven samples had discontinuous surface layers, their affinity for phosphating was almost the same as that of Sample No. 15 which was an as-cold rolled steel sheet, and the paint coat formed on each of these samples exhibited wet adhesion entirely the same as that of Sample No. 15.

Samples No. 5, 13 and 14 were comparative samples. In Samples No. 5 and 13 contained so much Sn in the surface layer that uneven deposition of phosphate crystals was conspicuous. Sample No. 14 had no problem with the surface layer but since the inner layer situated right beneath was made of highly anodic Zn plating, it dissolved preferentially in the phosphating step, exhibiting only a low P/(P+H) ratio, and the paint coat had poor wet adhesion.

As will be apparent from the foregoing description, steel sheet with multiplex coating of the present invention has affinity for phosphating as high as that of cold-rolled steel sheets, and a paint film having very good wet adhesion can be formed by commerical operations of cationic electrodeposition. This high affinity for phosphating is not lost even if micro-cracks are introduced in the surface layer by forming operations under severe conditions. As another advantage, the surface layer need not be continuous, so the desired product can be manufactured by a conventional simple plating bath requiring no special provision such as addition of a complexing agent in the bath. The multiplex coating on the steel sheet of the present invention is highly resistant to corrosion and can be given a paint coat by cationic electrodeposition without forming tiny craters because the surface layer of the multilayer coating has a high Fe content and can form, upon phosphating, a phosphophyllite-rich film having high resistance to alkali. For these reasons, the steel sheet with multilayer coating of the present invention will prove very useful when applied to automotive bodies.

Although the invention has been described with preferred embodiments, it is to be understood that variations and modifications may be employed without departing from the concept of the invention as defined in the following claims.

What is claimed is:

1. A steel sheet having a multilayer electroplating, which comprises on at least one side a discontinuous surface layer of an electrodeposited material selected from Fe base alloys and Fe—Zn base alloys, which contains Sn in an amount of 0.01 to 50 mg/m$^2$, and a layer of an electrodeposited material selected from Zn—Ni alloys and Zn—Fe alloys, which lies right under said discontinuous surface layer.

2. The steel sheet defined in claim 1, in which the discontinuous surface layer contains Sn in an amount of 1.0 to 50 mg/m$^2$.

3. The steel sheet defined in claim 2, in which the amount of Sn is 3.0 to 30 mg/m$^2$.

4. The steel sheet defined in claim 1, in which the amount of said surface layer is 1–10 g/m$^2$.

5. The steel sheet defined in claim 4, in which the amount of said surface layer is 1.5 to 6 g/m$^2$.

6. The steel sheet defined in claim 1, in which the Zn—Ni alloys contain 5 to 20% by weight of Ni, and the Zn—Fe alloys contain 10 to 40% by weight of Fe.

7. A Steel sheet having a multilayer electroplating, which comprises on at least one side a discontinuous surface layer of an electrodeposited Fe—Zn base alloy, which contains Sn in an amount of 0.01 to 50 mg/m$^2$, and a layer of an electrodeposited material selected from Zn—Ni alloys and Zn—Fe alloys, which lies right under said discontinous surface layer.

8. The steel sheet defined in claim 7, in which the discontinuous surface layer contains Sn in an amount of 1.0 to 50 mg/m$^2$.

9. The steel sheet defined in claim 8, in which the amount of Sn is 3.0 to 30 mg/m$^2$.

10. The steel sheet defined in claim 7 in which the amount of said surface layer is 1–10 g/m$^2$.

11. The steel sheet defined in claim 10, in which the amount of said surface layer is 1.5 to 6 g/m$^2$.

12. The steel sheet defined in claim 7, in which the surface layer Fe—Zn base alloy electrodeposit contains 5 to 50% by weight of Zn.

13. The steel sheet defined in claim 12, in which the surface layer Fe—Zn base alloy electrodeposit contains not more than 35% by weight of Zn.

14. The steel sheet defined in claim 7, in which the Zn—Ni alloys contain 5 to 20% by weight of Ni, and the Zn—Fe alloys contain 10 to 40% by weight of Fe.

* * * * *